US005457474A

United States Patent [19]

Ikeda

[11] Patent Number: 5,457,474

[45] Date of Patent: Oct. 10, 1995

[54] DRIVING CIRCUIT FOR ACTIVE-MATRIX TYPE LIQUID CRYSTAL DISPLAY

[75] Inventor: Naoyasu Ikeda, Tokyo, Japan

[73] Assignee: NEC Corporation, Tokyo, Japan

[21] Appl. No.: 334,375

[22] Filed: Nov. 3, 1994

[30] Foreign Application Priority Data

Nov. 11, 1993 [JP] Japan ..... 5-282242

[51] Int. Cl.[6] ..... G09G 3/36

[52] U.S. Cl. ..... 345/92; 345/103; 359/59

[58] Field of Search ..... 345/92, 93, 87, 345/103; 359/55, 57, 59

[56] References Cited

U.S. PATENT DOCUMENTS 5,285,302 2/1994 Wu ..... 359/59

FOREIGN PATENT DOCUMENTS 60-66236 4/1985 Japan .
61-116392 6/1986 Japan .
3-174884 7/1991 Japan .
4-97122 3/1992 Japan .

OTHER PUBLICATIONS

Masahiko Akiyama, Shuichi Uchikoga, Takeo Sakakubo, Takashi Koizumi, Kouji Suzuki, "Effects of Source/Drain Electrodes Overlapping on the Stopper–Insulator in a Self–Aligned TFT–LCD," Toshiba Electron Device Engineering Laboratory, Yokohama, Japan, SID 91 Digest, Section 4.1, pp. 10–13.

Kikuo Ono, Takeshi Tanaka, Nobutake Konishi, "TFT–LCD Optical Characteristics Simulator CLIS," Kitachi Research Laboratory, Hitachi, Ltd., Ikaraki, Japan, SID 91 Digest, Section 4.4, pp. 22–25.

*Primary Examiner*—Ulysses Weldon
*Assistant Examiner*—Matthew Luu
*Attorney, Agent, or Firm*—Whitham, Curtis, Whitham & McGinn

[57] ABSTRACT

An active-matrix type LCD includes a plurality of gate bus lines and a plurality of drain bus lines each intersecting with a corresponding gate bus line at right angle, and a liquid crystal provided between a substrate on which a TFT is formed at the intersection of the gate bus line and drain bus line, and a substrate on which a common electrode is formed. The active-matrix type LCD further includes a device for producing a compensation signal to compensate a source electrode voltage of the TFT for each divided section of the display area of the active-matrix type LCD, the each divided section being obtained by dividing the display area into a plurality of sections for exposure to light when a pattern of the electrode is formed, and an adder circuit for adding the compensation signal and associated image signal, and producing the added signal.

4 Claims, 5 Drawing Sheets

DRIVING CIRCUIT FOR ACTIVE-MATRIX TYPE LIQUID CRYSTAL DISPLAY

BACKGROUND OF THE INVENTION

The present invention relates to a driving circuit for active-matrix type liquid crystal displays (hereinafter referred to as AM-LCDs), and more specifically, to a driving circuit for an AM-LCD using Thin-film Field effect Transistors (hereinafter referred to as TFTs).

AM-LCDs have been attracting attention in recent years as thin-film, light-weight, space-saving displays having high quality picture comparable with that of CRTs. The equivalent circuit of a part of the display unit of the conventional AM-LCD is shown in FIG. 6. As seen in FIG. 6, this equivalent circuit comprises parallel gate bus lines 38–40 and parallel drain bus lines 41–43, intersecting at right angles each other. Near the intersections between the gate bus lines 38–40 and the drain bus lines 41–43 are formed TFTs 26 and 27 whose gates are connected with gate bus line 38 and whose drains are connected with drain bus lines 41 and 42, and TFTs 28 and 29 whose gates are connected with gate bus line 39 and whose drains are connected with drain bus lines 41 and 42. These TFTs 26, 27, 28 and 29 are connected with pixel capacitances 34, 35, 36 and 37 whose pairs of electrodes are filled with a liquid crystal. The electrodes of the pixel capacitances 34, 35, 36 and 37, on the counter side to the electrodes connected with the source of the TFTs, are connected with the counter electrode power source 44. As shown in FIG. 6, capacitance components 30, 31, 32 and 33 between the gates and the sources are interposed between the TFTs 26, 27, 28 and 29 and the corresponding gate bus lines 38 and 39.

FIG. 7 shows waveforms of voltages applied to terminals of the AM-LCD having a circuit construction as shown in FIG. 6. In FIG. 7, as the gate electrode voltage 201 rises up $V_{G2}$ from $V_{G1}$ in the state "off" of the gate through the gate bus line, a drain signal is written in the pixel electrodes connected with the TFTs that are "on" now, the drain electrode voltage 202 rises up, and the pixel electrode voltage 203 also rises up in accordance with a predetermined time constant.

When the gate electrode voltage falls down to $V_{G1}$, the drain electrode voltage 202 comes down, and the TFTs are turned off, then a voltage shift occurs in the pixel electrode voltage 203 by an amount ΔV defined by the following equation(1), and the electrode potential is maintained as it is.

$$\Delta V = C_{GS}(V_{G2}-V_{G1})/(C_{LC}+C_{GS}) \quad (1)$$

where, $C_{GS}$ is a capacity value of the respective capacitance components 30–33 between the gate and the source of TFTs 26–29, and $C_{LC}$ is a capacity value of the pixel capacitances 34–37. As obvious from the above equation(1), a voltage difference $V_{LC}$ between the pixel electrode voltage 203 and the counter electrode voltage 204 is retained, for example, in the pixel capacitance 34 as shown in FIG. 7.

In recent years, the size of these direct-view AM-LCDs of a conventional type employing the above driving circuit have been enlarged, for instance, the size larger than 10 inches is required for personal computers, and the size larger than 20 inches is required for work stations and high-quality TVs such as EDTV and HDTV.

Generally, for the production of the display units of such AM-LCDs, a pattern is formed by using a photolithographic method or the like. For large displays as mentioned above, the area of a display unit is too large to permit the entire pattern to be exposed to light at a time. The display area is therefore divided into a plurality of pattern sections for the exposure to light. According to this divisional exposure, a misalignment of the overlapped pattern sections between adjacent pattern sections causes a capacity difference between the gate and source of TFTs for the respective sections. Since the voltage shift ΔV depends on the capacity between the gate and the source, as understandable from Eq.(1), the voltage values of ΔV vary from section to section due to the above misalignment of overlapped pattern sections. For example, under the condition where the display area is divided into two sections of Section A on the left-hand side and Section B on the right-hand side, the two sections are exposed to light, $\Delta V_1$ represents the voltage shift in Section A while $\Delta V_2$ represents the voltage shift in Section B, and the amount of the overlap between the gate and the source of TFTs in Section B is larger than that in Section A, the voltage shift ΔV is smaller than $\Delta V_2$.

A delay is caused in the signal passed through the gate bus line due to the resistance and capacitance components contained in the lines. For this reason, as shown in FIG. 8, the gate of the TFT is turned off as soon as the input side gate voltage 301 at the input portion of the gate bus line drops, while the terminated side gate voltage 302 at the terminated portion is not turned off immediately due to the signal delay, permitting the writing operation for a while. As a result, the voltage shift of the applied liquid crystal voltage when the gate voltage is turned off shows a different value between the voltage shift $\Delta V_3$ corresponding to the input side pixel voltage 303 at the input portion and the voltage shift $\Delta V_4$ corresponding to the terminated side pixel voltage 304 at the terminated portion, as shown in FIG. 8.

For the reasons described above, the voltage shift value for the display area, ΔV, varies depending on the exposed sections and the direction along the gate bus lines. Even if the voltage of the counter electrode voltage source 44 is shifted by an amount equal to the voltage shift at the corresponding position to include no DC component in the liquid crystal driving voltage in a certain section of the display area, the DC component will still remain in the driving voltage in a different section due to the difference in voltage shift, resulting in the defects of image quality deteriorations such as uneven brightness, flicker and image sticking, and shortening the life of the liquid crystal.

SUMMARY OF THE INVENTION

It is therefore an object of the present invention to provide a driving circuit for overcoming the above problems of the conventional systems.

According to one aspect of the present invention there is provided a driving circuit for a display area of an active-matrix type LCD having a plurality of gate bus lines and a plurality of drain bus lines each intersecting with a corresponding gate bus line at right angle, and a liquid crystal provided between a substrate on which a TFT is formed at the intersection of the gate bus line and drain bus line, and a substrate on which a common electrode is formed, comprising, means for producing a compensation signal to compensate a source electrode voltage of the TFT for each divided section of the display area of the active-matrix type LCD, the each divided section being obtained by dividing the display area into a plurality of sections for exposure to light when a pattern of the electrode is formed; and an adder circuit for adding the compensation signal and associated image signal, and producing the added signal.

According to another aspect of the present invention, there is provided a driving circuit for a display area of an active-matrix type LCD having a plurality of gate bus lines and a plurality of drain bus lines each intersecting with a corresponding gate bus line at right angle, and a liquid crystal provided between a substrate on which a TFT is formed at the intersection of the gate bus line and drain bus line, and a substrate on which a common electrode is formed, comprising, means for producing a compensation signal for a compensate source electrode voltage difference caused after turning off of the TFT in the direction along the gate bus lines due to signal delays in the gate bus lines, for an image signal supplied to the drain bus lines; and an adder for adding the compensation signal and an associate image signal.

According to another aspect of the present invention, there is provided a driving circuit for a display area of an active-matrix type LCD having a plurality of gate bus lines and a plurality of drain bus lines each intersecting with a corresponding gate bus line at right angle, and a liquid crystal provided between a substrate on which a TFT is formed at the intersection of the gate bus line and drain bus line, and a substrate on which a common electrode is formed, comprising, a liquid crystal driving voltage generation circuit for generating a pixel voltage corresponding to an image signal based on an image data, a vertical synchronization signal and a horizontal synchronization signal; a compensation voltage generation circuit for determining divided sections of the display area and producing a compensation voltage suited for each of the determined sections; and an adder for adding a pixel voltage and a section compensation voltage from the liquid crystal driving voltage generation circuit and the compensation voltage generation circuit and producing the added signal as a compensation signal.

According to still another aspect of the present invention, there is provided a driving circuit for a display area of an active-matrix type LCD having a plurality of gate bus lines and a plurality of drain bus lines each intersecting with a corresponding gate bus line at right angle, and a liquid crystal provided between a substrate on which a TFT is formed at the intersection of the gate bus line and drain bus line, and a substrate on which a common electrode is formed, comprising, a liquid crystal driving voltage generation circuit for generating a pixel voltage based on an image data, a vertical synchronization signal and a horizontal synchronization signal; a compensation voltage generation circuit for determining positions, along the gate bus line, of voltage values of the pixel voltage supplied from the liquid crystal driving voltage generation circuit based on a vertical synchronization signal and a horizontal synchronization signal and generating a section compensation voltage corresponding to such positions; and an adder for adding a pixel voltage and a section compensation voltage supplied from the liquid crystal driving voltage generation circuit and the compensation voltage generation circuit and subsequently producing the added signal as a compensation signal.

Other objects and features will be clarified from the following description with reference to attached drawings.

DETAILED DESCRIPTION OF THE PREFERRED EMBODIMENTS

Figure 1:
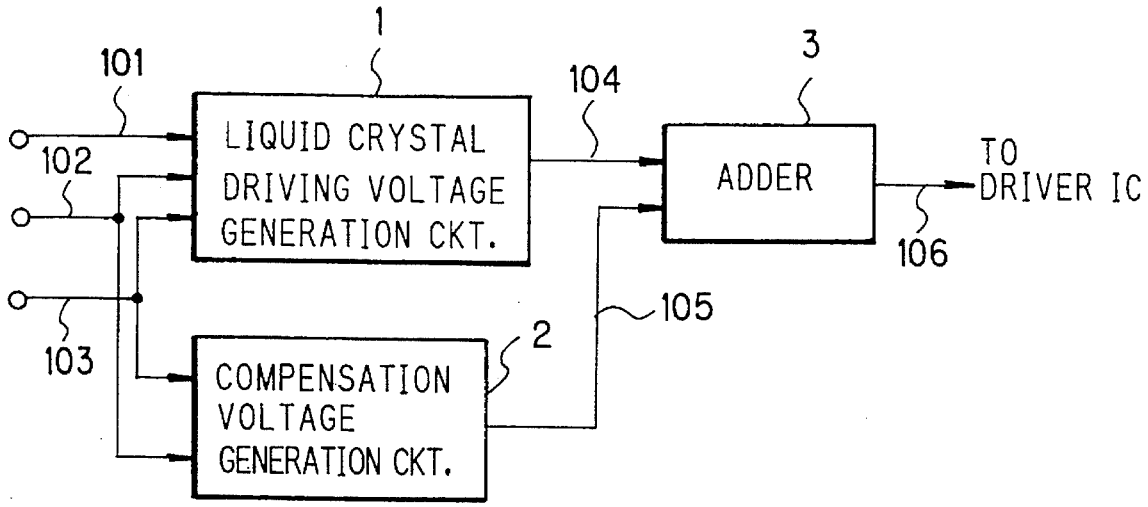
FIG. 1 is a block diagram of the first preferred embodiment of the present invention.

As shown in FIG. 1, this preferred embodiment basically comprises a liquid crystal driving voltage generation circuit 1 which generates a pixel voltage 104 corresponding to an image signal based on an image data 101, a vertical synchronization signal 102 and a horizontal synchronization signal 103, a compensation voltage generation circuit 2 which determines the divided section of the display area based on the vertical synchronization signal 102 and the horizontal synchronization signal 103 and produces a compensation voltage 105 suited for each of the determined sections, and an adder 3 which adds two signals (pixel voltage 104 and section compensation voltage 105) from the liquid crystal driving voltage generation circuit 1 and the compensation voltage generation circuit 2 and produces the added signal as a compensation signal 106.

Figure 2:
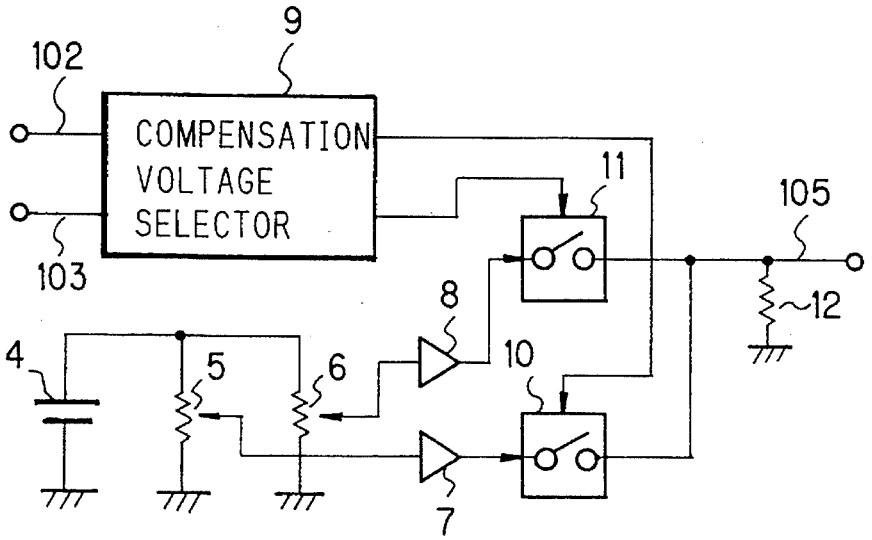
FIGS. 2 and 3 show examples of schematical diagrams of the compensation voltage generation circuit 2 and the adder 3 of FIG. 1.
Figure 3:
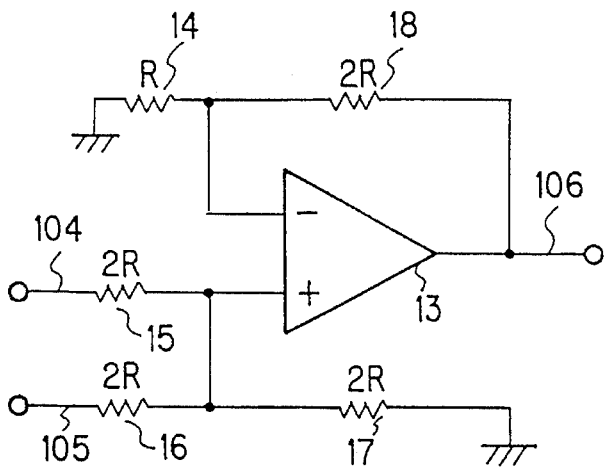

FIGS. 2 and 3 show examples of schematical diagrams of the compensation voltage generation circuit 2 and the adder 3, respectively.

As shown in FIG. 2, the compensation voltage generation circuit 2 comprises a compensation voltage power source 4, variable resistors 5 and 6, buffers 7 and 8, a compensation voltage selector 9, analog switches 10 and 11, and a resistor 12. As shown in FIG. 3, the adder 3 comprises an operational amplifier 13, and resistors 14, 15, 16, 17 and 18.

With reference to FIGS. 1, 2 and 3, the preferred embodiment of the present invention will be described for a case where the display area of the area of the LCD having TFT is divided into two sections of a left section and a right section as a border at center portion for the exposure. In this case, there result a different amount of overlap of TFT pattern sections for the divided sections and a relation of $\Delta V_A > \Delta V_B$, where $\Delta V_A$ represents the amount of voltage shift in the left section and $\Delta V_B$ represents the amount of voltage shift in the right section.

In the compensation voltage generation circuit 2 shown in FIG. 2, the output voltages of the variable resistors 5 and 6 connected with the compensation voltage power source 4 are adjusted so that the section compensation voltages in the sections are equal to the voltage retained in the liquid crystal. Since there is a relation of $\Delta V_A > \Delta V_B$ in this embodiment as mentioned above, the output voltages of the variable resistors 5 and 6 are adjusted such that if, for example, the former is 0 V, then the latter is $(\Delta V_A - \Delta V_B)$. The output voltages of the variable resistors 5 and 6 are applied through the buffers 8 and 7 to the analog switches 11 and 10.

On the other hand, the compensation voltage selector 9 determines whether the image data 101 being transmitted is in the left section or in the right section of the display area based on the vertical synchronization signal 102 and the horizontal synchronization signal 103 and produces a control signal to control the analog switch 11 or 10 such that, when the image data 101 is in the left section, the analog switch 11, which is connected through the buffer 8 with the variable resistor 6 and produces an output voltage ($\Delta V_A - \Delta V_B$), is turned on, and, when it is in the right section, the analog switch 10, which is connected through the buffer 7 with the variable resistor 5 and produces an output voltage 0 V, is turned on. Synchronous with the vertical synchronization signal 102 and the horizontal synchronization signal 103 applied to the compensation voltage selector 9, the compensation voltage generation circuit 2 supplies a sectional compensation voltage 105 of ($\Delta V_A - \Delta V_B$) if the image data 101 being transmitted is in the left section, or supplies a sectional compensation voltage 105 of 0 V if it is in the right section to the adder 3.

Now, when the vertical synchronization signal 102 and the horizontal synchronization signal 103 are supplied to the liquid crystal driving voltage generation circuit 1 at a timing to select pixels in the left section of the display area, the voltage $V_{OUT1}$ representing the value of the pixel voltage 104 which is supplied from the liquid crystal driving voltage generation circuit 1 and the voltage value ($\Delta V_A \Delta V_B$) of the sectional compensation voltage 105 from the compensation voltage generation circuit 2 are supplied to the adder 3 shown in FIG. 1. In this case, the voltage at a value of $\{V_{OUT1} + (\Delta V_A - \Delta V_B)\}$ is supplied as the compensation voltage 106. Similarly, when the vertical synchronization signal 102 and the horizontal synchronization signal 103 are supplied to the liquid crystal driving voltage generation circuit 1 at a timing to select pixels in the right section of the display area, the voltage $V_{OUT1}$ representing the value of the pixel voltage 104 supplied from the liquid crystal driving voltage generation circuit 1 and the voltage 0V of the section compensation voltage 105 from the compensation voltage generation circuit 2 are supplied to the adder 3 shown in FIG. 1. In this case, the voltage at a value of $V_{OUT1}$ is supplied as the compensation voltage 106.

In the foregoing, a voltage obtained by subtracting the voltage shift from an output of the operational amplifier 13 is supplied to the respective pixel electrodes. Thus, a voltage $V_{LC}$ defined by the following Eq.(2) is applied to the left section, and a voltage $V_{RC}$ defined by the following Eq.(3) is applied to the right section.

$$\begin{aligned} V_{LC} &= \{V_{OUT1} + (\Delta V_A - \Delta V_B)\} - \Delta V_A \\ &= V_{OUT1} - \Delta V_B \end{aligned} \tag{2}$$

$$\begin{aligned} V_{RC} &= (V_{OUT1} + 0) - \Delta V_B \\ &= V_{OUT1} - \Delta V_B \end{aligned} \tag{3}$$

As indicated by Eq.(2) and Eq.(3), an equal voltage is applied to both the left and right sections. It is therefore possible to apply the voltage including no DC component (free of DC component) to any sections of the display area by reducing the counter electrode voltage by $\Delta V_B$.

In the foregoing embodiment, all signals are processed by analog operators. But it is also possible to execute the processing in the digital form after converting the input analog signal into the digital signal, and finally converting the processed digital signal to the analog signal. Also, although in the above description of the preferred embodiment, the display area is divided into two sections, left and right, the present invention is not limited to this preferred embodiment, nor is restricted by the number and shape of divided sections.

Figure 4:
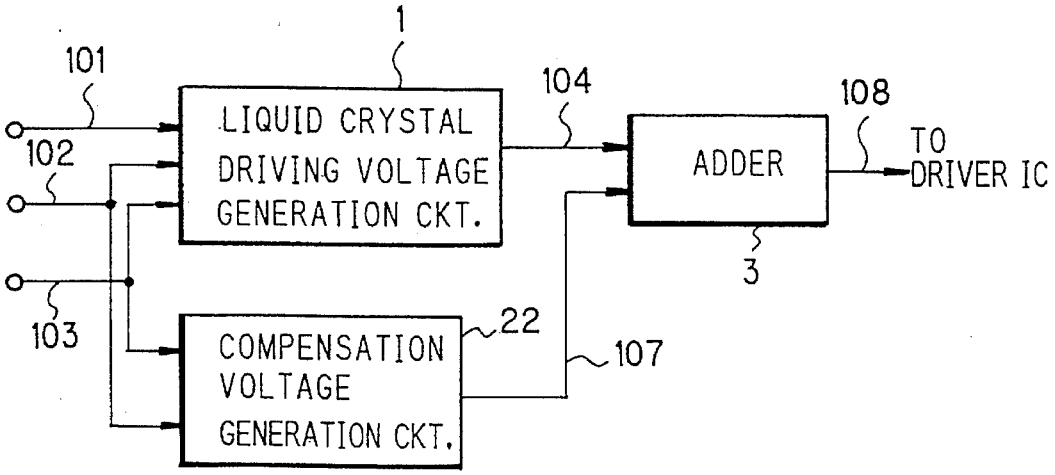
FIG. 4 is a block diagram showing this second preferred embodiment.

FIG. 4 is a block diagram showing the second preferred embodiment. This preferred embodiment basically comprises a liquid crystal driving voltage generation circuit 1 which generates a pixel voltage 104 based on the image data 101, the vertical synchronization signal 102 and the horizontal synchronization signal 103, a compensation voltage generation circuit 22 which determines the positions, along the gate bus line, of voltage values of the pixel voltage 104 supplied from the liquid crystal driving voltage generation circuit 1 based on the vertical synchronization signal 102 and the horizontal synchronization signal 103 and generates a section compensation voltage 107 corresponding to such positions, and an adder 3 which adds signals (pixel voltage 104 and section compensation voltage 107) supplied from the liquid crystal driving voltage generation circuit 1 and the compensation voltage generation circuit 22 and subsequently produces a compensation signal 108.

Figure 5:
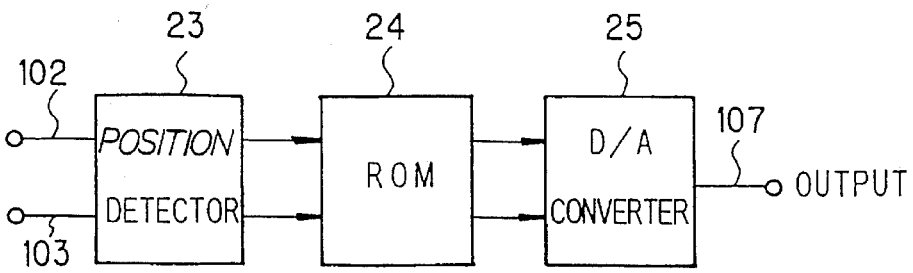
FIG. 5 is a diagram showing the construction of the compensation voltage generation circuit 22 of this embodiment.
Figure 6:
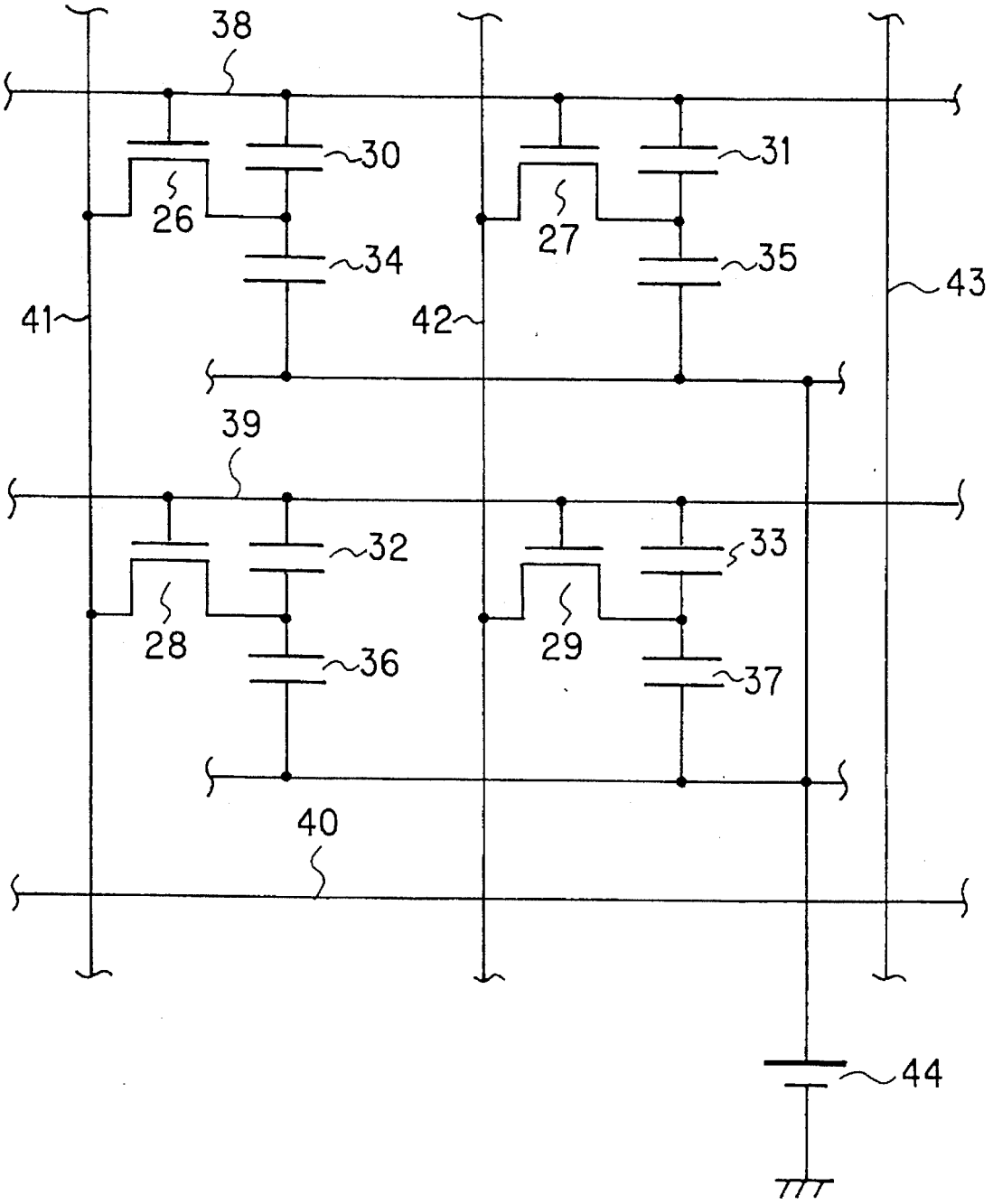
FIG. 6 is an equivalent circuit of a part of the display unit of the conventional AM-LCD.
Figure 7:
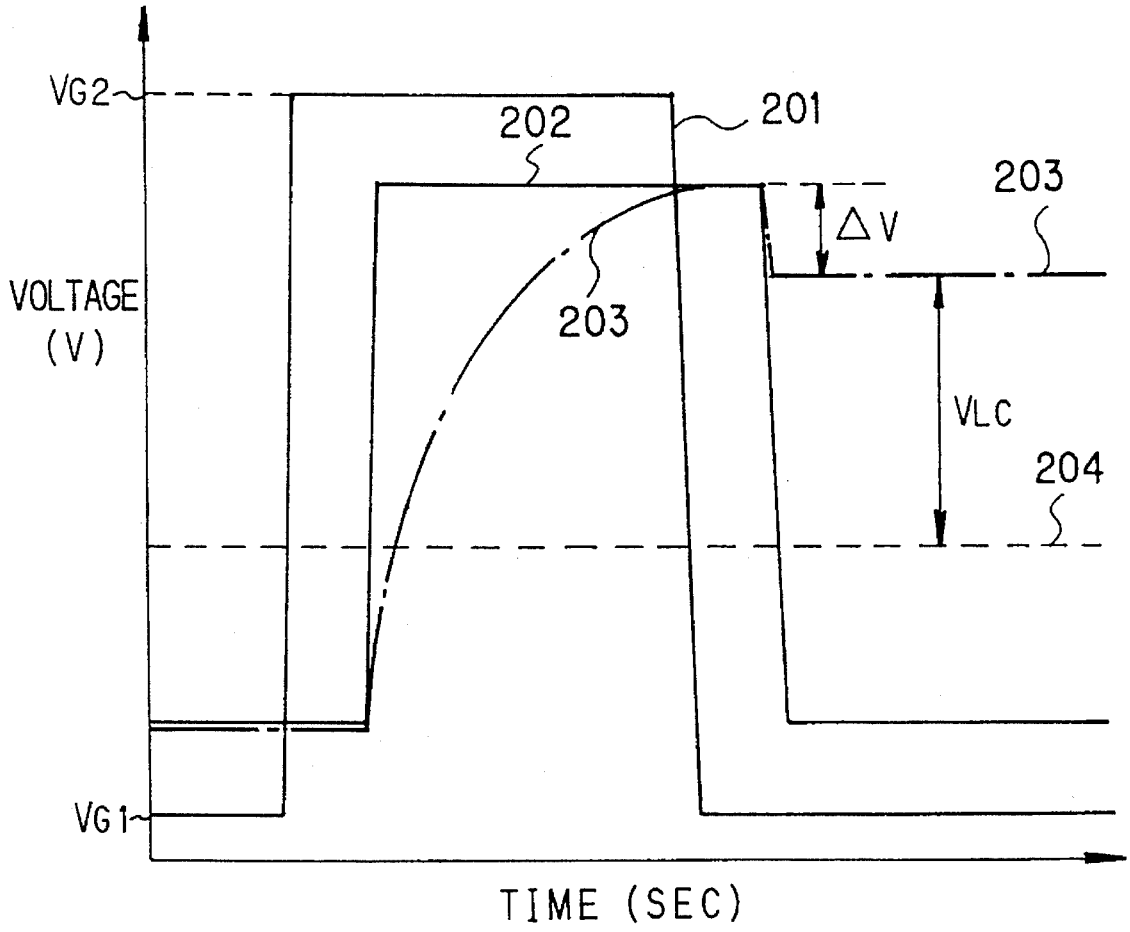
FIG. 7 shows waveforms of voltages applied to terminals of the AM-LCD having a circuit construction as shown in FIG. 6.
Figure 8:
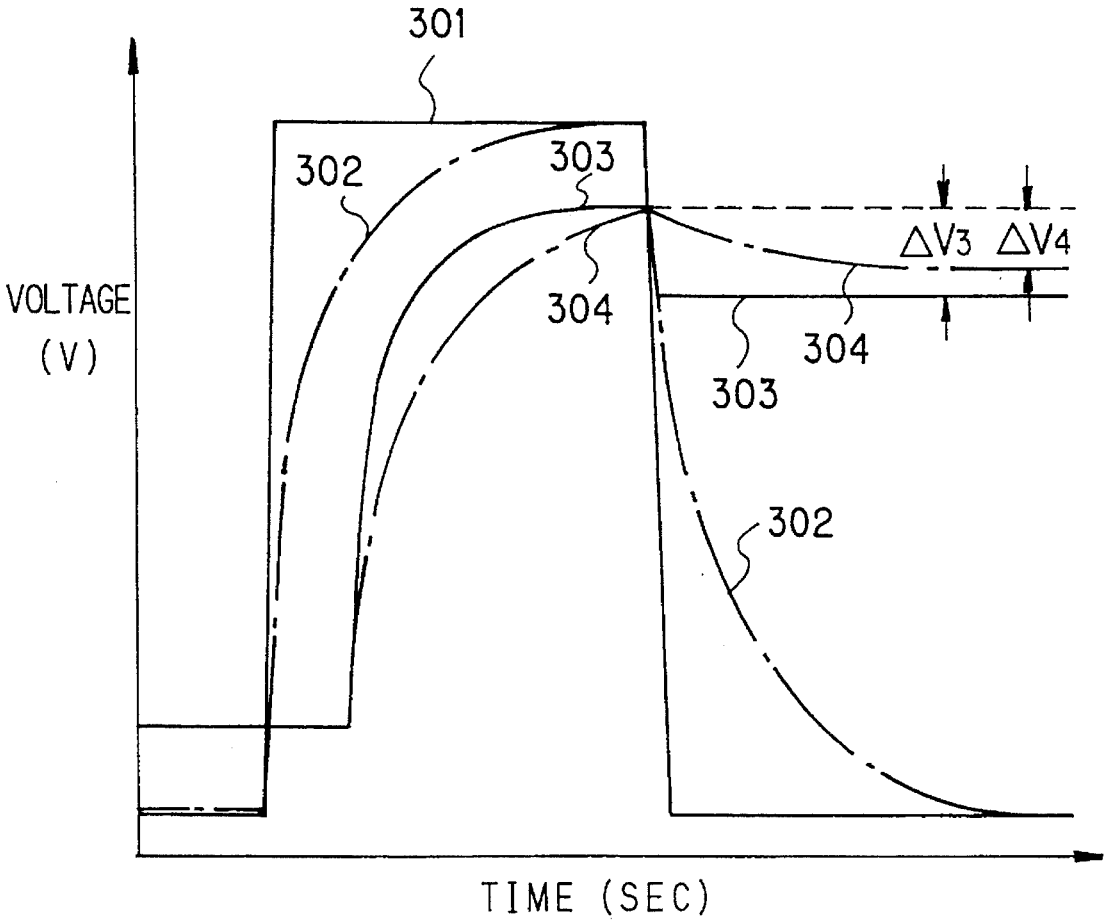
FIG. 8 shows waveforms of voltages applied to terminals of the AM-LCD having a circuit construction as shown in FIG. 6.

FIG. 5 is a diagram showing the construction of the compensation voltage generation circuit 22 of this embodiment. The compensation voltage generation circuit 22 comprises a position detector 23, an ROM 24, and a D/A converter. The construction of the liquid crystal driving voltage generation circuit 1 and the adder 3 of this second preferred embodiment may be the same as those of the first preferred embodiment.

With reference to FIGS. 4, 5 and 3, this preferred embodiment will be described for a case where a signal delay occurs in the gate bus line of the LCD having TFTs, the amount of the voltage shift is $\Delta V_A$ on the gate signal input side and $\Delta V_B$ on the terminated side, and the amount of the voltage shift arising in the pixels in the direction along the gate bus line therebetween linearly varies with the distance from the input side.

In FIG. 5, the position detector 23 determines, based on the vertical synchronization signal 102 and the horizontal synchronization signal 103 supplied thereto, which pixel is the image data 101 supplied to the liquid crystal driving voltage generation circuit 1 among the pixels, counted from the gate bus line input side in the direction along the gate bus line and supplies and stores a parallel data specifying the position of the pixel in the ROM 24. From the ROM 24 the compensation voltage data for the pixel position is read out and supplied to the D/A converter 25 to obtain the analog pixel position compensation voltage 107.

In FIG. 4, the pixel position compensation voltage 107 from the compensation voltage generation circuit 22 and the pixel voltage 104 from the liquid crystal driving voltage generation circuit 1 are added in the adder 3, and the added signal is produced as the compensation signal 108. The operation of the adder 3 in this process is same as in the comparable process in the first preferred embodiment and is therefore not described here.

In this second preferred embodiment, although all signal processings such as in the adder are performed by analog operators, it is also possible to perform in the digital form after converting the analog input signal into the digital signal, and finally converting the processed digital signal to the analog signal for the output of the compensation voltage. Also, the above description of this preferred embodiment assumes that the amount of the voltage shift at the pixel electrodes linearly varies in the direction from the input side towards the terminated side, however this is not restricted to this assumed condition. It goes without mentioning that, even when the amount of the voltage shift varies nonlinearly, the same effects can be achieved by employing a ROM which generates a voltage to compensate the amount of the voltage shift for each pixel position.

As described above, the present invention adjusts the voltage to be applied to both ends of each liquid crystal section when the pattern is exposed to light, thereby making it possible to provide displays of even images, free of such qualitative deteriorations as flicker, image sticking, and brightness variations due to the misalignment of the voltage shift, ΔV, resulting from unequal amounts of overlap of the patterns. Also, the present invention compensates the difference of the voltage shift, ΔV, in the direction along the bus line to provide displays of even images, free of such qualitative deteriorations as flicker, image sticking, and brightness variations due to the difference of the voltage shift, ΔV. Furthermore, the present invention permits greater tolerances for relative misalignments of patterns than permitted by conventional methods, improves yield, eliminates DC components, and causes an effect to provide longer liquid crystal life.

What is claimed is:

1. A driving circuit for a display area of an active-matrix type liquid crystal display (LCD) for receiving an image signal and having a plurality of gate bus lines and a plurality of drain bus lines each intersecting with a corresponding gate bus line at a right angle, and a liquid crystal for receiving an image signal and provided between a substrate on which a thin-film transistor (TFT) is formed at the intersection of said gate bus line and drain bus line, and a substrate on which a common electrode is formed, said driving circuit comprising:

means for producing a compensation signal to compensate a source electrode voltage of said TFT for each divided section of the display area of said active-matrix type LCD, said each divided section being obtained by dividing the display area into a plurality of sections each for exposure to light when a pattern of the common electrode is formed; and an adder circuit, operatively coupled to said means for producing a compensation signal, for adding said compensation signal and an associated image signal received by said LCD, and for producing an added signal.

2. A driving circuit for a display area of an active-matrix type liquid crystal display (LCD) for receiving an image signal and having a plurality of gate bus lines and a plurality of drain bus lines each intersecting with a corresponding gate bus line at a right angle, and a liquid crystal provided between a substrate on which a thin-film transistor (TFT) is formed at the intersection of said gate bus line and drain bus line, and a substrate on which a common electrode is formed, said driving circuit comprising:

means for producing a compensation signal for a compensate source electrode voltage difference caused after turning off of said TFT in the direction along said gate bus lines due to signal delays in said gate bus lines, for an image signal supplied to said drain bus lines of said LCD; and an adder, operatively coupled to said means for producing a compensation, for adding said compensation signal and an associated image signal received by said LCD.

3. A driving circuit for a display area of an active-matrix type liquid crystal display (LCD) having a plurality of gate bus lines and a plurality of drain bus lines each intersecting with a corresponding gate bus line at a right angle, and a liquid crystal provided between a substrate on which a thin-film transistor (TFT) is formed at the intersection of said gate bus line and drain bus line, and a substrate on which a common electrode is formed, said driving circuit comprising:

a liquid crystal driving voltage generation circuit for generating a pixel voltage corresponding to an image signal based on an image data, a vertical synchronization signal and a horizontal synchronization signal;

a compensation voltage generation circuit for determining divided sections of the display area and for producing a compensation voltage suited for each of the determined sections; and an adder for adding a pixel voltage and a section compensation voltage from said liquid crystal driving voltage generation circuit and said compensation voltage generation circuit, respectively, and for producing an added signal as a compensation signal.

4. A driving circuit for a display area of an active-matrix type liquid crystal display (LCD) having a plurality of gate bus lines and a plurality of drain bus lines each intersecting with a corresponding gate bus line at right angle, and a liquid crystal provided between a substrate on which a thin-film transistor (TFT) is formed at the intersection of said gate bus line and drain bus line, and a substrate on which a common electrode is formed, said driving circuit comprising:

a liquid crystal driving voltage generation circuit for generating a pixel voltage based on an image data, a vertical synchronization signal and a horizontal synchronization signal;

a compensation voltage generation circuit for determining positions, along the gate bus line, of voltage values of the pixel voltage supplied from said liquid crystal driving voltage generation circuit based on a vertical synchronization signal and a horizontal synchronization signal and for generating a section compensation voltage corresponding to such positions; and an adder for adding a pixel voltage and a section compensation voltage supplied from said liquid crystal driving voltage generation circuit and said compensation voltage generation circuit, respectively, and for subsequently producing an added signal as a compensation signal.

* * * * *